US008333556B2

(12) United States Patent
Hettinger et al.

(10) Patent No.: US 8,333,556 B2
(45) Date of Patent: Dec. 18, 2012

(54) TURBOCHARGER AND VARIABLE-NOZZLE CARTRIDGE THEREFOR

(75) Inventors: Raphaël Hettinger, Hadol (FR); Joel Castan, Chantraine (FR); Jean-Luc Perrin, Girmont (FR); Lorrain Sausse, Vincey (FR)

(73) Assignee: Honeywell International Inc., Morristown, NJ (US)

( * ) Notice: Subject to any disclaimer, the term of this patent is extended or adjusted under 35 U.S.C. 154(b) by 1280 days.

(21) Appl. No.: 12/090,501

(22) PCT Filed: Oct. 18, 2005

(86) PCT No.: PCT/US2005/037622

§ 371 (c)(1),
(2), (4) Date: Apr. 17, 2008

(87) PCT Pub. No.: WO2007/046798

PCT Pub. Date: Apr. 26, 2007

(65) Prior Publication Data

US 2008/0260520 A1 Oct. 23, 2008

(51) Int. Cl.
*F01D 17/12* (2006.01)

(52) U.S. Cl. ..... 415/165; 415/214.1

(58) Field of Classification Search ..... 415/159, 415/165, 214.1

See application file for complete search history.

(56) References Cited

U.S. PATENT DOCUMENTS

| | | | | |
|---|---|---|---|---|
| 2,860,827 | A * | 11/1958 | Egli | 415/164 |
| 4,389,845 | A | 6/1983 | Koike | |
| 4,741,666 | A | 5/1988 | Shimizu et al. | |
| 4,770,603 | A | 9/1988 | Engels et al. | |
| 5,947,681 | A | 9/1999 | Rochford | |
| 6,269,642 | B1 | 8/2001 | Arnold et al. | |
| 6,625,984 | B2 | 9/2003 | Gerke et al. | |
| 2005/0252210 | A1 | 11/2005 | Shiraishi et al. | |
| 2006/0133931 | A1 | 6/2006 | Burmester et al. | |
| 2011/0236197 | A1 * | 9/2011 | Burmeister et al. | 415/204 |

FOREIGN PATENT DOCUMENTS

| | | |
|---|---|---|
| EP | 1099838 | 5/2001 |
| EP | 1642009 | 5/2004 |
| WO | 2004022926 | 3/2004 |
| WO | 2004035991 | 4/2004 |
| WO | 2004109063 | 12/2004 |
| WO | WO 2004/109062 A1 | 12/2004 |
| WO | WO 2004/109063 A1 | 12/2004 |
| WO | WO 2007/046798 A1 | 4/2007 |

OTHER PUBLICATIONS

PCT ISR/WO (PCT/US05/37622).

* cited by examiner

*Primary Examiner* — Edward Look
*Assistant Examiner* — Aaron R Eastman
(74) *Attorney, Agent, or Firm* — Alston & Bird LLP

(57) ABSTRACT

A variable-nozzle turbocharger includes a cartridge containing a variable vane mechanism connected between the center housing and the turbine housing. The cartridge comprises an annular nozzle ring supporting an array of rotatable vanes, an insert having a tubular portion sealingly received into the bore of the turbine housing and having a nozzle portion extending radially out from one end of the tubular portion and being axially spaced from the nozzle ring with the vanes therebetween, a plurality of spacers connected between the nozzle portion of the insert and the nozzle ring, and an annular retainer ring fastened to the center housing so as to capture the nozzle ring between the retainer ring and the center housing. The retainer ring is formed as a separate part from the insert ring and is mechanically and thermally decoupled from the insert.

19 Claims, 1 Drawing Sheet

TURBOCHARGER AND VARIABLE-NOZZLE CARTRIDGE THEREFOR

BACKGROUND OF THE INVENTION

Figure 1:
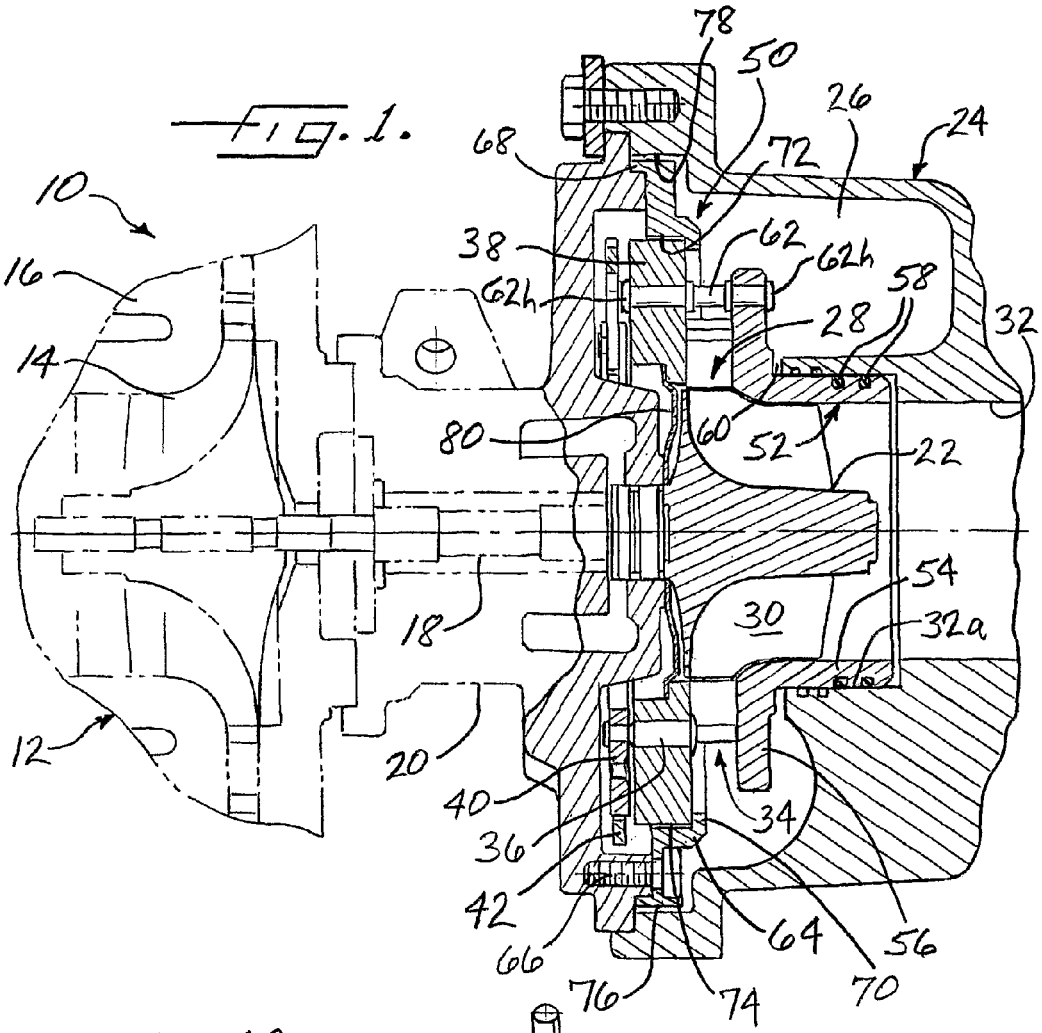

The present invention relates to turbochargers having a variable-nozzle turbine in which an array of movable vanes is disposed in the nozzle of the turbine for regulating exhaust gas flow into the turbine.

An exhaust gas-driven turbocharger is a device used in conjunction with an internal combustion engine for increasing the power output of the engine by compressing the air that is delivered to the air intake of the engine to be mixed with fuel and burned in the engine. A turbocharger comprises a compressor wheel mounted on one end of a shaft in a compressor housing and a turbine wheel mounted on the other end of the shaft in a turbine housing. Typically the turbine housing is formed separately from the compressor housing, and there is yet another center housing connected between the turbine and compressor housings for containing bearings for the shaft. The turbine housing defines a generally annular chamber that surrounds the turbine wheel and that receives exhaust gas from an engine. The turbine assembly includes a nozzle that leads from the chamber into the turbine wheel. The exhaust gas flows from the chamber through the nozzle to the turbine wheel and the turbine wheel is driven by the exhaust gas. The turbine thus extracts power from the exhaust gas and drives the compressor. The compressor receives ambient air through an inlet of the compressor housing and the air is compressed by the compressor wheel and is then discharged from the housing to the engine air intake.

One of the challenges in boosting engine performance with a turbocharger is achieving a desired amount of engine power output throughout the entire operating range of the engine. It has been found that this objective is often not readily attainable with a fixed-geometry turbocharger, and hence variable-geometry turbochargers have been developed with the objective of providing a greater degree of control over the amount of boost provided by the turbocharger. One type of variable-geometry turbocharger is the variable-nozzle turbocharger (VNT), which includes an array of variable vanes in the turbine nozzle. The vanes are pivotally mounted in the nozzle and are connected to a mechanism that enables the setting angles of the vanes to be varied. Changing the setting angles of the vanes has the effect of changing the effective flow area in the turbine nozzle, and thus the flow of exhaust gas to the turbine wheel can be regulated by controlling the vane positions. In this manner, the power output of the turbine can be regulated, which allows engine power output to be controlled to a greater extent than is generally possible with a fixed-geometry turbocharger.

The variable vane mechanism is relatively complicated and thus presents a challenge in terms of assembly of the turbocharger. Furthermore, the mechanism is located between the turbine housing, which gets quite hot because of its exposure to exhaust gases, and the center housing, which is at a much lower temperature than the turbine housing. Accordingly, the variable vane mechanism is subject to thermal stresses because of this temperature gradient.

BRIEF SUMMARY OF THE INVENTION

The present invention addresses the above needs and achieves other advantages, by providing a variable-nozzle turbocharger that includes a cartridge containing the variable vane mechanism. The turbine defines a nozzle through which exhaust gas is delivered to the turbine wheel, and a central bore through which exhaust gas is discharged after it passes through the turbine wheel. The cartridge is connected between the center housing and the turbine housing and comprises an assembly of:

- a generally annular nozzle ring and an array of vanes circumferentially spaced about the nozzle ring and disposed in the nozzle such that exhaust gas flows between the vanes to the turbine wheel, each vane being rotatably mounted to the nozzle ring and connected to a rotatable actuator ring such that rotation of the actuator ring rotates the vanes for regulating exhaust gas flow to the turbine wheel;
- an insert having a tubular portion sealingly received into the bore of the turbine housing and having a nozzle portion extending generally radially out from one end of the tubular portion, the nozzle portion being axially spaced from the nozzle ring such that the vanes extend between the nozzle ring and the nozzle portion;
- a plurality of spacers connected between the nozzle portion of the insert and the nozzle ring for securing the nozzle ring to the insert and maintaining an axial spacing between the nozzle portion of the insert and the nozzle ring; and
- a generally annular retainer ring fastened to the center housing in such a manner as to capture the nozzle ring between the retainer ring and the center housing, the retainer ring being formed as a separate part from the insert and being mechanically and thermally decoupled from the insert.

The cartridge is installable into the turbocharger and removable therefrom as a unit, which aids in the process of assembling the turbocharger. The mechanical and thermal decoupling of the retainer ring from the insert helps reduce the thermal stresses to which the cartridge is subjected as a result of the large temperature gradient between the turbine housing and the center housing. More particularly, the retainer ring is in thermal communication with the relatively low-temperature center housing, while the insert is in thermal communication with the relatively high-temperature turbine housing. The decoupling of the retainer ring from the insert reduces the thermal stresses to which these parts are subjected. Additionally, the cost and complexity of manufacturing are reduced by making these parts as separate members.

Preferably, the turbine housing is fastened to the center housing in such a manner that a gap is defined between the turbine housing and the retainer ring. This gap provides decoupling between the turbine housing and the retainer ring, which helps to reduce stresses that could otherwise be imposed on the cartridge as a result of differential thermal deformation between the turbine housing and cartridge.

Preferably, at least one sealing ring is disposed between the tubular portion of the insert and the turbine housing and is retained in a groove formed in a radially outer surface of the tubular portion of the insert. The at least one sealing ring spaces the outer surface of the tubular portion of the insert from an opposing inner surface of the turbine housing so as to substantially decouple the insert from the turbine housing.

Advantageously, the spacers are formed separately from the nozzle ring and the insert. The nozzle ring defines apertures that receive first end portions of the spacers. Each of the spacers has a first shoulder that abuts a face of the nozzle ring when the first end portion is received in the aperture. The nozzle portion of the insert also defines apertures for receiving second end portions of the spacers, and each spacer defines a second shoulder (spaced from the first shoulder by a distance generally corresponding to the axial width of the turbine nozzle) that abuts a face of the nozzle portion when the second end portion is received in the aperture of the nozzle portion. In one embodiment, there are three spacers that are uniformly spaced about the nozzle ring.

Preferably, the retainer ring has an axially facing surface that engages an opposing axially facing surface of the nozzle ring along a full 360° circumference so as to substantially seal an interface between the retainer ring and the nozzle ring.

Preferably, the nozzle ring includes a radially outer surface facing a radially inner surface of the retainer ring, and a radial gap is defined between the radially outer surface of the nozzle ring and the radially inner surface of the retainer ring, the radial gap allowing radial displacement of the nozzle ring relative to the retainer ring.

BRIEF DESCRIPTION OF THE SEVERAL VIEWS OF THE DRAWING(S)

Figure 2:
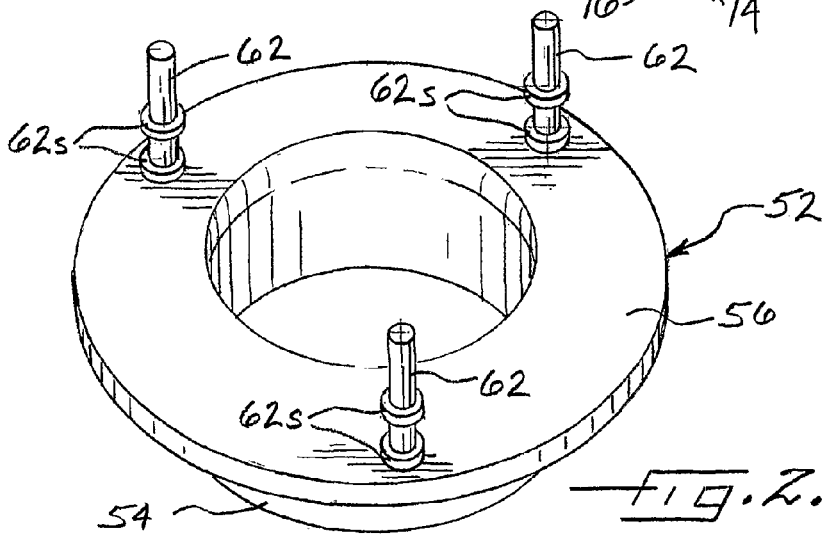

Having thus described the invention in general terms, reference will now be made to the accompanying drawings, which are not necessarily drawn to scale, and wherein:

FIG. 1 is a fragmentary cross-sectional view of a turbocharger in accordance with one embodiment of the invention; and FIG. 2 is a perspective view of a subassembly of a variable vane cartridge for the turbocharger in accordance with one embodiment of the invention.

DETAILED DESCRIPTION OF THE INVENTION

The present inventions now will be described more fully hereinafter with reference to the accompanying drawings, in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

A turbocharger 10 in accordance with one embodiment of the invention is illustrated in fragmentary perspective view in FIG. 1. The turbocharger comprises a compressor 12 having a compressor wheel or impeller 14 mounted in a compressor housing 16 on one end of a rotatable shaft 18. The shaft is supported in bearings (not specifically illustrated) mounted in a center housing 20 of the turbocharger. The shaft 18 is rotated by a turbine wheel 22 mounted on the other end of the shaft 18 from the compressor wheel, thereby rotatably driving the compressor wheel, which compresses air drawn in through the compressor inlet and delivers the compressed air to the intake of an internal combustion engine (not shown) for boosting the performance of the engine.

The turbocharger also includes a turbine housing 24 that houses the turbine wheel 22. The turbine housing defines a generally annular chamber 26 that surrounds the turbine wheel and that receives exhaust gas from the internal combustion engine for driving the turbine wheel. The exhaust gas is directed from the chamber 26 generally radially inwardly through a turbine nozzle 28 to the turbine wheel 22. As the exhaust gas flow through the passages between the blades 30 of the turbine wheel, the gas is expanded to a lower pressure, and the gas discharged from the wheel exits the turbine housing through a generally axial bore 32 therein.

The turbine nozzle 28 is a variable nozzle for varying the cross-sectional flow area through the nozzle so as to regulate flow into the turbine wheel. The nozzle includes a plurality of vanes 34 that are circumferentially spaced about the nozzle. Each vane is affixed to a pin 36 that passes through an aperture in a generally annular nozzle ring 38 that is mounted coaxially with respect to the turbine wheel 22. Each pin 36 is rotatable about its axis for rotating the attached vane. The nozzle ring 38 forms one wall of the flow passage of the nozzle 28. Each of the pins 36 has a vane arm 40 affixed to an end of the pin that protrudes out from the nozzle ring 38, and is engaged by a generally annular unison ring 42 (also referred to herein as an actuator ring) that is rotatable about its axis and that is coaxial with the nozzle ring 38. An actuator (not shown) is connected to the unison ring 42 for rotating it about its axis. When the unison ring is rotated, the vane arms 40 are rotated to cause the pins 36 to rotate about their axes, thereby rotating the vanes 34 so as to vary the cross-sectional flow area through the nozzle 28. As described thus far, the variable nozzle mechanism generally corresponds to a conventional variable nozzle having variable vanes. See, e.g., U.S. Pat. No. 7,946,116 (corresponding to EP1543220A1 and incorporated herein by reference) which shows such prior vane configurations in more detail.

In accordance with the invention, however, the variable vane mechanism is provided in the form of an improved cartridge 50 that is installable into and removable from the turbocharger as a unit. The cartridge 50 comprises the nozzle ring 38, vanes 34, pins 36, vane arms 40, and unison ring 42. The cartridge further comprises an insert 52 (shown in isolated perspective view in FIG. 2) that has a tubular portion 54 sealingly received into a portion 32*a* of the bore 32 of the turbine housing, and a nozzle portion 56 extending generally radially out from one end of the tubular portion 54, the nozzle portion 56 being axially spaced from the nozzle ring 38 such that the vanes 34 extend between the nozzle ring 38 and the nozzle portion 56. The bore portion 32*a* of the turbine housing has a radius that exceeds that of the remainder of the bore 32 by an amount slightly greater than the radial thickness of the tubular portion 54 of the insert 52. The radially outer surface of the tubular portion 54 has at least one circumferential groove, and preferably has two axially spaced grooves as shown in FIG. 1, in each of which a sealing ring 58 is retained for sealingly engaging the inner surface of the bore portion 32*a*. Advantageously, the outer diameter of the tubular portion 54 of the insert is slightly less than the inner diameter of the bore portion 32*a* so that a slight gap is defined therebetween, and only the sealing rings 58 make contact with the inner surface of the bore portion 32*a*. Additionally, there is a gap 60 between the nozzle portion 58 and the adjacent end of the turbine housing at the end of the bore portion 32*a*. In this manner, the insert 52 is mechanically and thermally decoupled from the turbine housing 24.

A plurality of spacers 62 are connected between the nozzle portion 56 of the insert 52 and the nozzle ring 38 for securing the nozzle ring to the insert and maintaining the desired axial spacing between the nozzle portion of the insert and the nozzle ring. Each spacer 62 passes through an aperture in the nozzle portion 56 and has an enlarged head 62*h* on the side of the nozzle portion 56 that faces away from the nozzle 28. Each spacer also has a pair of enlarged shoulders 62*s* axially spaced along the length of the spacer such that one shoulder 62*s* abuts the opposite side of the nozzle portion 56 and the other shoulder 62*s* abuts the facing surface of the nozzle ring 38, thereby setting the axial spacing between the nozzle ring and nozzle portion. An end portion of each spacer 62 passes through an aperture in the nozzle ring 38 and the distal end of this end portion is upset to form an enlarged head 62*h* to capture the nozzle ring. Advantageously, the spacers 62 are formed of a material having good high-temperature mechanical properties and a relatively low thermal conductivity, such as stainless steel (e.g., grade 310 stainless steel) or the like, so that the nozzle ring 38 and insert 52 are effectively thermally decoupled from each other.

The variable-vane cartridge 50 also comprises a generally annular retainer ring 64 fastened to the center housing 20 in such a manner as to capture the nozzle ring 38 between the retainer ring 64 and the center housing. The retainer ring 64 is formed as a separate part from the insert 52 and is mechanically and thermally decoupled from the insert. More specifically, the retainer ring comprises an annular ring that is fastened to the center housing using threaded fasteners 66. At its radially outer side, the retainer ring has an annular axially extending projection 68 that engages a shoulder on the center housing to restrain the retainer ring with respect to radially inward movement relative to the center housing. At its radially inner side, the retainer ring has an annular radially inwardly extending projection 70 that engages the surface of the nozzle ring 38 facing toward the insert 52. The engagement between the projection 70 and the nozzle ring 38 preferably is along a full 360° circumference of the nozzle ring so as to substantially seal the interface between the retainer ring and the nozzle ring. The projection 70 also assists the spacers 62 in restraining the nozzle ring with respect to axial movement in the direction toward the insert 52. Advantageously, the retainer ring 64 has a radially inner surface 72 facing toward a radially outer surface 74 of the nozzle ring 38, and the retainer ring surface 72 is slightly greater in diameter than the nozzle ring surface 74 such that there is a gap between these surfaces. This gap accommodates radial displacement of the nozzle ring relative to the retainer ring, such as may occur through differential thermal growth or other causes.

Additionally, the retainer ring 64 has a radially outer surface 76 that faces a radially inwardly facing surface 78 of the turbine housing 24. The turbine housing 24 is fastened to the center housing 20 in such a manner that a gap is defined between the inner surface 78 of the turbine housing and the outer surface 76 of the retainer ring. This gap provides mechanical and thermal decoupling between the turbine housing and the retainer ring.

The cartridge 50 further comprises a heat shroud 80 that is captively retained between the nozzle ring 38 and the center housing 20 when the cartridge is installed onto the center housing. The heat shroud 80 provides sealing between the nozzle ring and center housing to prevent hot exhaust gas from migrating between these parts into the cavity in which the vane arms 40 and unison ring 42 are disposed. The heat shroud 80 advantageously is a resiliently elastic material such as spring steel or the like, and the shroud is configured so that it is compressed in the axial direction between the nozzle ring 38 and the center housing 20 so that the restoring force of the shroud urges the shroud firmly against surfaces of the nozzle ring and center housing to substantially seal against these surfaces.

From the above description of one embodiment of the invention, it will be understood that the variable-vane cartridge 50 enables a number of advantages or characteristics to be attained. The avoidance of direct contact between the insert 52 and the turbine housing 24 and between the retainer ring 64 and the turbine housing provides mechanical and thermal decoupling between the turbine housing and these parts. The retainer ring 64 is connected with the relatively low-temperature center housing 20, while the insert 52 is connected with the much higher-temperature nozzle ring 38. Because the retainer ring and insert are thermally and mechanically decoupled, the temperature difference between these parts does not give rise to thermally induced stresses and deformations that could adversely affect the proper operation of the variable-vane mechanism. Thermal growth of the nozzle ring 38 in the radial direction is accommodated by the gap between the nozzle ring and the retainer ring 64. Furthermore, the separate formation of the insert 52 and the retainer ring 64 and the simple mechanical connection provided between the insert and the nozzle ring 38 via the spacers 62 substantially simplifies manufacturing and assembly of the variable-vane cartridge 50. In particular, this simple design avoids the need to keep very close tolerances on the various parts, thereby reducing the cost of production.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A turbocharger having a variable-nozzle turbine, comprising:

a turbine assembly comprising a turbine housing and a turbine wheel mounted in the turbine housing and connected to a rotatable shaft for rotation therewith, the turbine housing defining a chamber surrounding the turbine wheel for receiving exhaust gas from an engine and for supplying the exhaust gas to the turbine wheel, the turbine assembly defining a nozzle leading from the chamber generally radially inwardly to the turbine wheel, the turbine housing further defining an axially extending bore through which exhaust gas is discharged after passing through the turbine wheel;

a compressor assembly comprising a compressor housing and a compressor wheel mounted in the compressor housing and connected to the rotatable shaft for rotation therewith;

a center housing connected between the compressor housing and the turbine housing; and a cartridge connected between the center housing and the turbine housing, the cartridge comprising an assembly of:

a generally annular nozzle ring and an array of vanes circumferentially spaced about the nozzle ring and disposed in the nozzle such that exhaust gas flows between the vanes to the turbine wheel, each vane being rotatably mounted to the nozzle ring and connected to a rotatable actuator ring such that rotation of the actuator ring rotates the vanes for regulating exhaust gas flow to the turbine wheel;

an insert having a tubular portion sealingly received into the bore of the turbine housing and having a nozzle portion extending generally radially out from one end of the tubular portion, the nozzle portion being axially spaced from the nozzle ring such that the vanes extend between the nozzle ring and the nozzle portion;

a plurality of spacers connected between the nozzle portion of the insert and the nozzle ring for securing the nozzle ring to the insert and maintaining an axial spacing between the nozzle portion of the insert and the nozzle ring; and a generally annular retainer ring fastened to the center housing in such a manner as to capture the nozzle ring between the retainer ring and the center housing, the retainer ring being formed as a separate part from the insert and having no direct contact with either the insert or the turbine housing, such that the retainer ring is mechanically and thermally decoupled from the insert.

2. The turbocharger of claim 1, wherein the turbine housing is fastened to the center housing in such a manner that a gap is defined between the turbine housing and the retainer ring, the gap providing decoupling between the turbine housing and the retainer ring.

3. The turbocharger of claim 1, further comprising at least one sealing ring disposed between the tubular portion of the insert and the turbine housing.

4. The turbocharger of claim 3, wherein the at least one sealing ring is retained in a groove formed in a radially outer surface of the tubular portion of the insert.

5. The turbocharger of claim 4, wherein the at least one sealing ring spaces the outer surface of the tubular portion of the insert from an opposing inner surface of the turbine housing so as to substantially decouple the insert from the turbine housing.

6. The turbocharger of claim 1, wherein the spacers are formed separately from the nozzle ring and the insert.

7. The turbocharger of claim 6, wherein the nozzle ring defines apertures that receive first end portions of the spacers.

8. The turbocharger of claim 7, wherein each of the spacers has a first shoulder that is abutted by a face of the nozzle ring when the first end portion of the spacer is received in one of the apertures, the shoulders delimiting the axial spacing between the nozzle ring and the nozzle portion of the insert.

9. The turbocharger of claim 8, wherein the nozzle portion of the insert defines apertures that receive opposite second end portions of the spacers, each of the spacers having a second shoulder that abuts a face of the nozzle portion when the second end portion is received in one of the apertures of the nozzle portion.

10. The turbocharger of claim 1, wherein the retainer ring has an axially facing surface circumference so as to substantially seal an interface between the retainer ring and the nozzle ring.

11. The turbocharger of claim 1, wherein the nozzle ring includes a radially outer surface facing a radially inner surface of the retainer ring, and wherein a radial gap is defined between the radially outer surface of the nozzle ring and the radially inner surface of the retainer ring, the radial gap allowing radial displacement of the nozzle ring relative to the retainer ring.

12. A variable-nozzle turbine for a turbocharger, comprising:

a turbine housing and a turbine wheel mounted in the turbine housing and connected to a rotatable shaft for rotation therewith, the turbine housing defining a chamber surrounding the turbine wheel for receiving exhaust gas from an engine and for supplying the exhaust gas to the turbine wheel, the turbine assembly defining a nozzle leading from the chamber generally radially inwardly to the turbine wheel, the turbine housing further defining an axially extending bore through which exhaust gas is discharged after passing through the turbine wheel;

a generally annular nozzle ring and an array of vanes circumferentially spaced about the nozzle ring, each vane being rotatably mounted to the nozzle ring and connected to a rotatable actuator ring such that rotation of the actuator ring relative to the nozzle ring rotates the vanes for regulating exhaust gas flow through the array of vanes;

an insert having a tubular portion sealingly received into the bore of a turbine housing and having a nozzle portion extending generally radially out from one end of the tubular portion, the nozzle portion being axially spaced from the nozzle ring such that the vanes extend between the nozzle ring and the nozzle portion;

a plurality of spacers connected between the nozzle portion of the insert and the nozzle ring for securing the nozzle ring to the insert and maintaining an axial spacing between the nozzle portion of the insert and the nozzle ring; and a generally annular retainer ring structured and arranged to be fastened to a center housing of the turbocharger in such a manner as to capture the nozzle ring between the retainer ring and the center housing, the retainer ring being formed as a separate part from the insert and having no direct contact with either the insert or the turbine housing, such that the retainer ring is mechanically and thermally decoupled from the insert.

13. The variable-nozzle turbine of claim 12, further comprising at least one sealing ring retained in a groove formed in a radially outer surface of the tubular portion of the insert for sealing against a surface of the bore of the turbine housing.

14. The variable-nozzle turbine of claim 12, wherein the spacers are joined to the nozzle portion of the insert and project axially therefrom.

15. The variable-nozzle turbine of claim 14, wherein the nozzle ring defines apertures that receive first end portions of the spacers.

16. The variable-nozzle turbine of claim 15, wherein each of the spacers has a first shoulder that is abutted by a face of the nozzle ring when the first end portion of the spacer is received in one of the apertures, the shoulders delimiting the axial spacing between the nozzle ring and the nozzle portion of the insert.

17. The variable-nozzle turbine of claim 16, wherein the tubular portion of the insert defines apertures that receive opposite second end portions of the spacers, each of the spacers having a second shoulder that abuts a face of the tubular portion when the second end portion is received in one of the apertures of the tubular portion.

18. The variable-nozzle turbine of claim 12, wherein the retainer ring has an axially facing surface that engages an opposing axially facing surface of the nozzle ring along a full 360° circumference so as to substantially seal an interface between the retainer ring and the nozzle ring.

19. The variable-nozzle turbine of claim 12, wherein the nozzle ring includes a radially outer surface facing a radially inner surface of the retainer ring, and wherein a radial gap is defined between the radially outer surface of the nozzle ring and the radially inner surface of the retainer ring, the radial gap allowing radial displacement of the nozzle ring relative to the retainer ring.

* * * * *